US012551813B2

(12) United States Patent
Hsiang

(10) Patent No.: US 12,551,813 B2
(45) Date of Patent: Feb. 17, 2026

(54) MODULAR BLOCK SYSTEM

(71) Applicant: Kim Wood Studio, LLC, Mountain Lakes, NJ (US)

(72) Inventor: Kimberly Hsiang, Mountain Lakes, NJ (US)

(73) Assignee: Kim Wood Studio, LLC

( * ) Notice: Subject to any disclaimer, the term of this patent is extended or adjusted under 35 U.S.C. 154(b) by 84 days.

(21) Appl. No.: 17/959,330

(22) Filed: Oct. 4, 2022

(65) Prior Publication Data

US 2023/0141115 A1 May 11, 2023

Related U.S. Application Data

(60) Provisional application No. 63/277,227, filed on Nov. 9, 2021.

(51) Int. Cl.
*A63H 33/06* (2006.01)
*A63H 33/04* (2006.01)

(52) U.S. Cl.
CPC ..... *A63H 33/062* (2013.01); *A63H 33/046* (2013.01)

(58) Field of Classification Search
CPC ..... A63H 33/008; A63H 33/12; A63H 33/062
See application file for complete search history.

(56) References Cited

U.S. PATENT DOCUMENTS 1,661,690 A * 3/1928 Buchman ..... A47C 31/11 5/639
2,061,510 A * 11/1936 Drumpelmann ..... A63H 33/062 446/116
2,548,547 A * 4/1951 Melrose ..... A61G 7/05715 5/723
4,242,767 A * 1/1981 McMullen ..... A47D 13/00 5/640
4,631,765 A * 12/1986 Casey ..... A47G 9/0207 428/33
4,878,258 A * 11/1989 Casey ..... A47G 9/0207 428/44
5,133,096 A * 7/1992 Neumann ..... A61G 7/05723 5/724
5,352,149 A * 10/1994 Melashenko ..... A47G 5/00 446/490

(Continued)

FOREIGN PATENT DOCUMENTS

DE 19546442 A1 * 6/1997 ..... A63H 33/04
DE 202007014978 U1 * 4/2008 ..... A47D 11/00

(Continued)

OTHER PUBLICATIONS

Translation DE202012012685U1 (Year: 2013).*

*Primary Examiner* — Eugene L Kim
*Assistant Examiner* — Alyssa M Hylinski
(74) *Attorney, Agent, or Firm* — Gearhart Law LLC

(57) ABSTRACT

Herein is a modular building element that may be combined in a number of ways to form unique articles. The modular building elements may be sold as a kit and marketed as a children's toy. The modular building element may have a front and a back with fasteners disposed on at least one of the front and back. Additional elements such as support elements and connecting elements may further be included to expand upon the functionality of the modular building element.

7 Claims, 8 Drawing Sheets

(56) References Cited

U.S. PATENT DOCUMENTS

| | | | | | |
|---|---|---|---|---|---|
| 5,632,071 | A * | 5/1997 | Maunder | A47H 13/00 | 24/DIG. 37 |
| 5,713,089 | A * | 2/1998 | Ferrante | A47G 9/0207 | 5/923 |
| 5,769,106 | A * | 6/1998 | Achuff | A45F 4/02 | 135/97 |
| 5,970,541 | A * | 10/1999 | Chiang | A47D 11/00 | 5/420 |
| 7,086,101 | B2 * | 8/2006 | Welch | A47D 13/083 | 5/427 |
| 8,015,637 | B2 * | 9/2011 | Papen | A47D 15/003 | 5/482 |
| D737,019 | S * | 8/2015 | Jensen | D2/502 | |
| 9,458,867 | B2 * | 10/2016 | Maunder | F16B 5/0048 | |
| 10,550,634 | B1 * | 2/2020 | Holland | E06B 9/06 | |
| 11,076,706 | B2 * | 8/2021 | McLusky | A47D 5/00 | |
| 11,602,234 | B1 * | 3/2023 | Fort | A61G 17/08 | |
| 11,602,235 | B2 * | 3/2023 | Harvey, Jr. | A47G 9/0207 | |
| 2003/0153243 | A1 * | 8/2003 | Haas | A63H 33/048 | 446/85 |
| 2008/0099060 | A1 * | 5/2008 | Stocking | A63H 33/008 | 135/115 |
| 2008/0289105 | A1 * | 11/2008 | Ranzau | A47G 9/0223 | 5/482 |
| 2017/0341719 | A1 * | 11/2017 | Bair | A47C 27/088 | |
| 2021/0045472 | A1 * | 2/2021 | Abedinzadeh Kivi | A62B 18/025 | |

FOREIGN PATENT DOCUMENTS

| | | | | |
|---|---|---|---|---|
| DE | 202012012685 | U1 * | 9/2013 | A63H 33/101 |
| JP | 2006230989 | A * | 9/2006 | |
| JP | 2013103115 | A * | 5/2013 | |

* cited by examiner

MODULAR BLOCK SYSTEM

CROSS-REFERENCE TO RELATED APPLICATIONS

This application claims priority to U.S. Application Ser. No. 63/277,227 filed on Nov. 9, 2021, the contents of which are herein fully incorporated by reference in its entirety.

FIELD OF THE EMBODIMENTS

The field of the embodiments relates to modular building elements that may be combined in a number of ways to form unique articles. In at least one embodiment, the modular building embodiment is embodied as a textile-based children's toy that is used to promote the building of articles if varying complexities. In other embodiments, the modular building element may be utilized by individuals or users of all ages.

BACKGROUND OF THE EMBODIMENTS

Over the years there have been several different toy building block sets created in an attempt to amuse and educate children. Various sets or kits are commercially available for use by children in constructing toys and other playthings. Different sets or kits have different purposes. For example, one may be focused on two-dimensional construction whereas others are focused on three-dimensional construction. Even further, the overall complexity and purpose of the sets or kits may vary. It is desirable as children advance in age and dexterity, that the various playthings available to them advance accordingly.

For example, one such kit (Lego®) comprises interlocking blocks that can be assembled to form model buildings, vehicles, characters, and numerous other objects. However, these blocks are small and susceptible to choking by small children. Children can also hurt themselves and each other by stepping on or throwing the hard blocks.

Another well-known construction kit comprises perforated metal and plastic strips that can be connected to one another by various fasteners (KNEX®), Such kits again have the disadvantage that they are made of hard objects having jagged corners and edges and include many small parts. These objects could injure children when thrown, stepped on, eaten, or otherwise misused.

Further, it is desirable to enable the building of soft, textile-based structures as an alternative to hard and non-deformable structures. Such a soft, textile-based structure may provide heightened flexibility regarding use such as safely simulating sewing, which traditionally involves complex machinery and sharp objects. Such a soft, textile based modular building kit would provide a medium for children, who are interested in creating textile structures but who may not possess an advanced skill set or access to specialized equipment, the ability to do so safely and effectively.

The above and other kits are also limited in terms of what can be created by the kits based on the components and pieces purchased. It is advantageous for children to have highly versatile building elements without limitations of predefined shapes or modes of operation and further that are safe for use and cannot readily injure, choke, or cause other harm to a child or user. The present invention and its embodiments meet and exceed these objectives.

Review of Related Technology:

U.S. Pat. No. 8,272,072 pertains to a reversible, seamless article of clothing and a system for constructing reversible seamless garments and accessories by assembling and attaching a plurality of reversible and interchangeable panels of the article of clothing with plurality of fasteners. The panel elements have a plurality of edges with a plurality of buttonholes adjacent to the edges. The fasteners are elastomeric two-headed button studs. The panel elements are attached by matching the buttonholes of the elements to form the article of clothing and inserting the studs into the buttonholes to fasten the panel elements. A plurality of trim elements have buttonholes adjacent to the edges and can be attached to the article of clothing by inserting the stud into a trim buttonhole and a buttonhole on the garment. With the system of construction using reversible elements with buttonholes and stud fasteners, accessories, such as tote bags and watch bracelets, can be constructed.

U.S. Patent Application 2003/0153243 pertains to a toy building construction set which comprises a plurality of geometrically shaped thin panels. Each panel has loop and hook strips positioned at borders of the geometrically shaped thin panels, which can be used to attach the panels to one another. A number of different large-scale structures can be made by children using these safe, light weight panels which simulate actual structures found in architecture.

U.S. Patent Application 2010/0178846 pertains to a partial undergarment for covering the cleavage area of the chest exposed by a low-cut article of clothing, using a panel that may be fastened and removed from the article of clothing. A method for affixing a panel traversing the cleavage area of the chest exposed by a low-cut article of clothing, with steps that include affixing the means for fastening to the panel and the article of clothing and affixing the panel to the article of clothing. A partial undergarment concealing cleavage from exposure when low cut outer garments are worn over a bra, the partial undergarment comprising a cleavage concealing panel that affixes to the inside front of the bra.

European Patent Application 2789374 pertains to a toy comprising a plate having a front side, a backside a perimeter and a flap with a flexible part protruding out from the perimeter. The flexible part comprises a male touch fastener surface and a corresponding female touch fastener surface facing away from the male touch fastener surface. The male touch fastener surface corresponds to the front side of the plate and the female touch fastener surface corresponds to the backside of the plate.

International Application Wo1998/040143 pertains to a toy made from flexible construction pieces of hook-and-loop material having hook for engageable by hook-and-loop interengagement with loop formations for releasably securing the pieces to one another. The pieces each have a hook formation on one face thereof and a loop formation on an opposite face thereof. The hook and loop formations extend to the edges of the pieces. The pieces may be bent and attached to one another to form structural components such as tubes and curved panels which are quite rigid despite the flexibility of the construction pieces themselves. The pieces may be assembled to form toys which appeal to children of either sex. The toys so made are rigid and are yet soft enough so that they are not damaged, and do not do damage, if they are dropped during play.

Thus, there is a need for a modular building element that can be used to create a variety of articles of varying complexities. The modular building element should be kid-friendly and allow for virtually any skill set to use the modular building element. The present invention and its embodiments meet and exceed these needs.

BRIEF SUMMARY OF THE EMBODIMENTS

Described herein is a modular building element that may be a part of a modular building kit. The modular building element is preferably a textile-based material having structures configured to allow for the connecting or coupling of multiple modular building elements to be joined to one another.

The modular building element may generally have a body portion and support portions. The supports or support portions may generally be tubular to allow additional support elements to pass therethrough to facilitate the joining of multiple modular building elements. When the modular building elements are quadrilateral in nature, various objects such as pocketbooks, clothing, toys, and blankets may be formed from the joined elements. Further, in some instances, printed indicia on the modular building elements may allow for educational or interactive elements.

In at least one aspect of the present invention, there is a modular building element that includes a body having a front side and a back side, a first support being coupled to a first side of the body, a second support being coupled to a second side of the body, and a plurality of fastening elements with at least two of the plurality of fastening elements being coupled to the front side of the body and at least two of the plurality of fastening elements being coupled to the first support or the second support.

The modular building element may also include where the first support includes a length of material having a first end and a second end with both of the first end and the second end coupled to the first side of the body.

The modular building element may also include where the second support includes a length of material having a first end and a second end with both of the first end and the second end coupled to the second side of the body.

The modular building element may also include where the body is a quadrilateral.

The modular may also include where the plurality of fastening elements are a snap, magnet, clip, or a combination thereof.

The modular may also include where the plurality of fastening elements on the first support and the second support are located at a top end and a bottom end of the first support and the second support. Other technical features may be readily apparent to one skilled in the art from the following figures, descriptions, and claims.

In one aspect, the modular building element has four fastening elements coupled to the front side of the body with one of the four fastening elements being positioned near a vertex of the quadrilateral.

In another aspect of the present invention, there is a modular building element that includes a body having a front side, a back side, a first edge, and a second edge, where the body is formed from a first textile-based material, a first support being coupled to the first edge of the body, where the first support includes a first channel passing therethrough, and where the first support is formed from a second textile-based material. The modular building element also includes a second support being coupled to a second side of the body, where the second support includes a second channel passing therethrough, and where the second support is formed from a third textile-based material; and a plurality of fastening elements with at least two of the plurality of fastening elements being coupled to the front side of the body and at least two of the plurality of fastening elements being coupled to each of the first support and the second support.

The modular building element may also include a support element.

The modular building element may also include where the first textile-based material, the second textile-based material, and the third textile-based material are the same or different.

The modular building element may also include where the plurality of fastening elements disposed on the first support and the second support are on the same side of the modular building element.

The modular building element may also include where the plurality of fastening elements disposed on the body are on an opposing side of the modular building element from the plurality of fastening elements disposed on both of the first support and the second support. Other technical features may be readily apparent to one skilled in the art from the following figures, descriptions, and claims.

In yet another aspect of the present invention, there is a modular building kit that includes a plurality of modular building elements with each of the plurality of modular building elements having a body with a front side and a back side, a first support being coupled to a first side of the body, a second support being coupled to a second side of the body, and a plurality of fastening elements with at least two of the plurality of fastening elements being coupled to the front side of the body and at least two of the plurality of fastening elements being coupled to the first support or the second support, and at least two support structures.

The modular building kit may also include a threading device and a connecting structure.

The modular building element may also include where the support element configured to pass through the first channel or the second channel.

The modular building element may also include where the support element is rigid.

The modular building element may also be removable from the first channel or the second channel.

The modular building kit may also include here the threading device has a first end and a second end with an aperture disposed at the first end, aperture configured to receive the connecting structure therethrough.

The modular building kit may also include here the connecting structure is a length of ribbon.

The modular building kit may also include where the body of the plurality of modular building elements has differing shapes.

In general, the present invention succeeds in conferring the following, and others not mentioned, benefits and objectives.

It is an object of the present invention to provide a modular building element that is lightweight and easy to use.

It is an object of the present invention to provide a modular building element that is child-friendly.

It is an object of the present invention to provide a modular building element that can be used to build a variety of articles.

It is an object of the present invention to provide a modular building element that is flexible and resilient.

It is an object of the present invention to provide a modular building element that is sold amongst other components as part of a kit.

It is an object of the present invention to provide a modular building element that can be used to make a pocketbook.

It is an object of the present invention to provide a modular building element that can be used to make a blanket.

It is an object of the present invention to provide a modular building element that can be used to make an article of clothing.

It is an object of the present invention to provide a modular building element that can be used to make a toy.

It is an object of the present ion to ide a modular building element that is educational.

Other technical features may be readily apparent to one skilled in the art from the following figures, descriptions, and claims.

DETAILED DESCRIPTION OF THE EMBODIMENTS

Figure 1A:
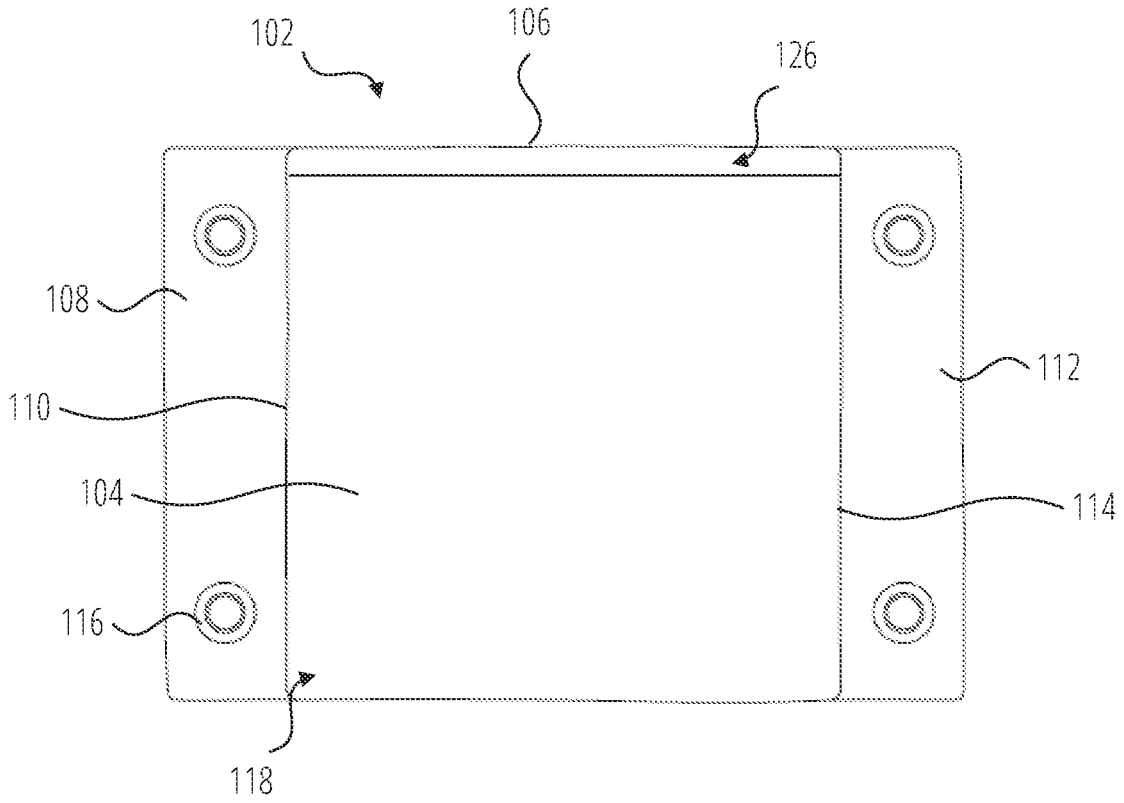
FIG. 1A illustrates a front view of a modular building element in accordance with one embodiment.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 1B:
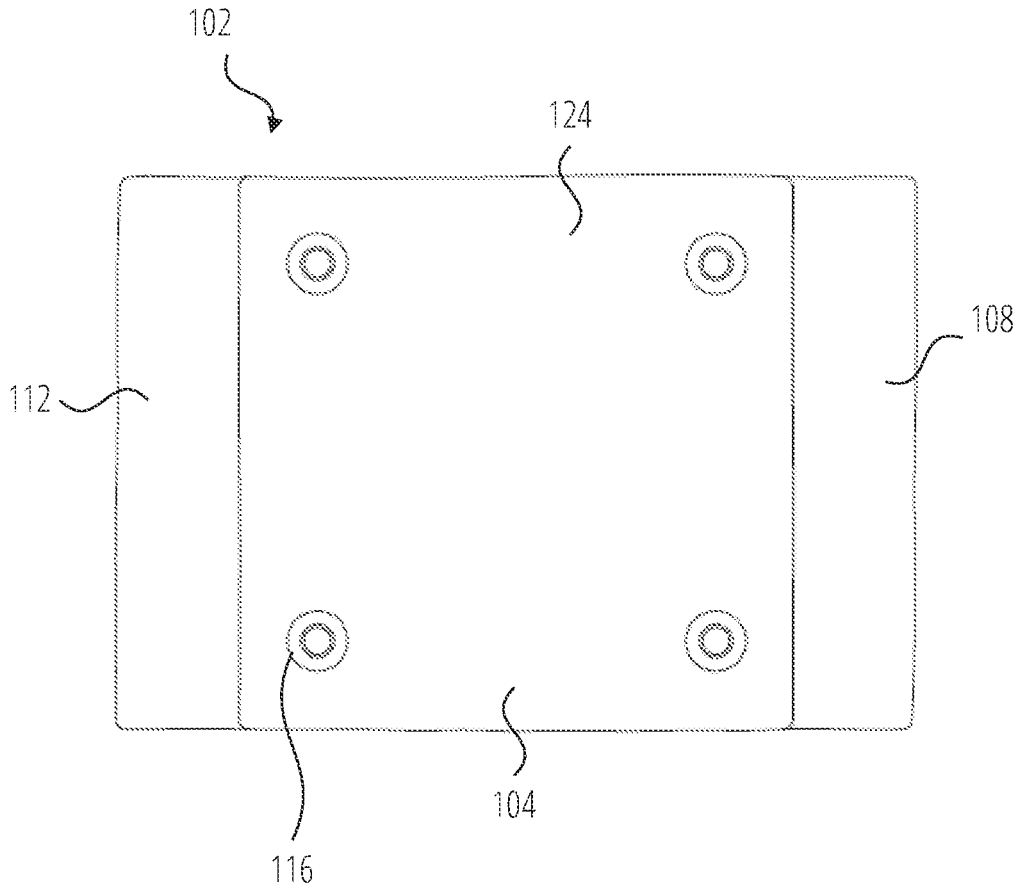
FIG. 1B illustrates a back view of a modular building element in accordance with one embodiment.
Figure 1C:
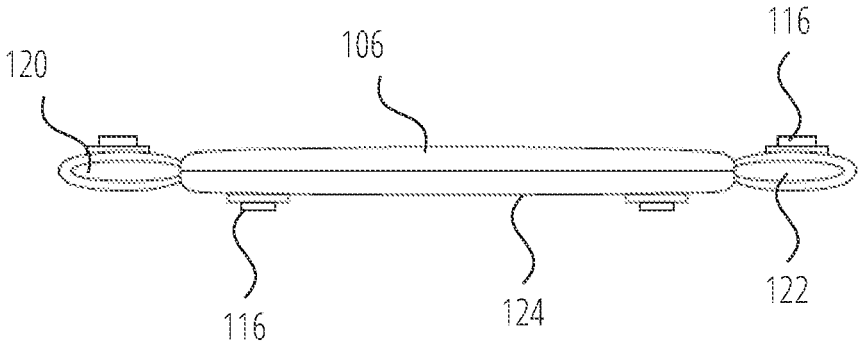
FIG. 1C illustrates a top view of a modular building element in accordance with one embodiment.

Referring now to FIGS. 1A-1C, shown is one embodiment of the modular building element 102. Here, the modular building element 102 has at least a body 104, a front side 106, a back side 124, a first support 108, a first side 110, a second support 112, a second side 114, a plurality of fastening elements 116, a vertex 118, and a pocket 126.

Here, the modular building element 102 may be comprised of a textile-based material. The composition of the various elements or portions of the modular building element 102 may be formed from the same or a different textile as the other elements or portions. The modular building element 102 may be comprised of woven or un wen fabric, cloth, terrycloth, woven or woven fibers of wool, flax, cotton, and/or yarn, and synthetic textile including but not limited to nylon, polyester, and/or acrylic, co-polymers (e.g. Spandex®) or any combination(s) thereof. Various other materials may be used in the construction of the modular building element 102 and its structures such as but not limited to plastics, metals, composites, resins, and the like or any combination thereof. Plastics used in the construction of the modular building element 102 may include polyethylene terephthalate (PET), polyethylene (PE), high-density polyethylene, polyvinyl chloride (PVC), polyvinylidene chloride (PVDC), low-density polyethylene (LDPE), polypropylene (PP), polystyrene (PS), high impact polystyrene (HIPS) and polycarbonate (PC), or any combination thereof. Composites may include but are not limited to fiber-reinforced plastics, metal composites, carbon fiber, Kevlar®, and the like. Metals may comprise lightweight metals such as aluminum and other pure metals as well as various alloys.

The modular building element 102 has a body 104 having a front side 106 and a back side 124. The body 104 is preferably a quadrilateral in shape but may take on any shape necessary to fulfill the user's needs. The body 104 may further be comprised of a first panel and a second panel coupled via any suitable mechanical and/or chemical means. The body 104 may further be filled with some amount of material to provide the desired weight, rigidity, softness, etc. that is desired. The outer surface of the body 104 may have surface ornamentation thereon. Said surface ornamentation may be purely for aesthetic purposes or may be for educational, information, etc. purposes.

On either (or both) of a front side 106 or a back side 124 of the body 104 there are disposed a plurality of fastening elements 116. As shown in FIG. 1A, these plurality of fastening elements 116 are located at each respective vertex 118 of the body 104. However, the plurality of fastening elements 116 may be located at any position upon an outer surface of the body 104. These plurality of fastening elements 116 are one of the structural features that allow for the joining of multiple modular building elements 102 as the plurality of fastening elements 116 between multiple modular building elements 102 (within a kit or otherwise) are configured to be complementary to one another. For example, the plurality of fastening elements 116 disposed on the body 104 may be a set of male or female snaps configured to be joined with the opposing snap of another (second) body 104. The plurality of fastening elements 116 is not limited to snaps and may comprise any fastening element such as but not limited to hook and loop fasteners (Velcro®), rivets, magnets, clips, adhesives, and the like or some combination thereof.

In a preferred embodiment, there is a plurality of fastening elements 116 disposed on both the body 104 and the first support 108 and the second support 112. Preferably, in such a configuration, the plurality of fastening elements 116 disposed on the first support 108 and the second support 112 are on an opposing side of the modular building element 102 than from the plurality of fastening elements 116 disposed on the body 104. Further, the plurality of fastening elements 116 disposed on the first support 108 and the second support 112 are similar in that each are configured to pair with one of the plurality of fastening elements 116 on another modular building element 102. For example, if male/female snaps are being used, then all of the plurality of fastening elements 116 on the first support 108 and the second support 112 are female snaps and all of the plurality of fastening elements 116 on the body 104 are male snaps or vice versa. This allows for the proper joining of multiple modular building elements 102 in accordance with the embodiments of the present invention.

While the plurality of fastening elements 116 may be located anywhere on the modular building element 102, it is preferable that if located on the body 104, the plurality of fastening elements 116 are located at vertices 118, and if located on the first support 108/second support 112 are located near a top end and a bottom end of each of the respective support as shown here in FIGS. 1A-C. The plurality of fastening elements 116 located on the first support 108 and second support 112 are also to be positioned such that the distance between at least a first fastening element and a second fastening element of the first support 108/second support 112 are aligned with the distance between two fastening elements located on the body 104 of the modular building element 102.

On a first side 110 or edge of the body 104 is a first support 108 and on the second side 114 or edge of the body 104 there is a second support 112. The first support 108 and second support 112 may be coupled to the body 104 via any suitable mechanical and/or chemical means. Each of the first support 108 and the second support 112 may be the same or different as any other support attached or coupled to the body 104.

Figure 2:
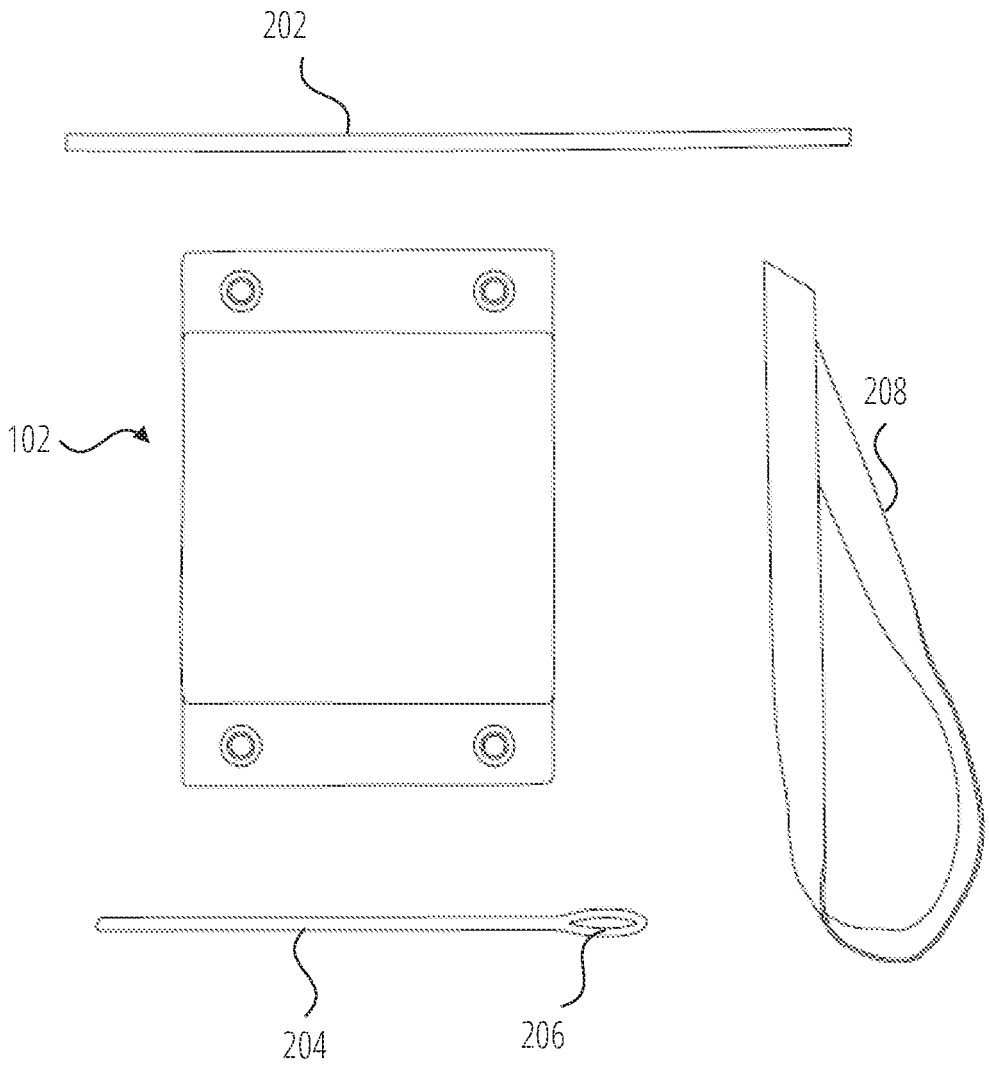
FIG. 2 illustrates a modular building element with accompanying support elements in accordance with one embodiment.

In general, each of the first support 108 and the second support 112 have a first side or edge and a second side or edge. Each of the first side and the second side of the first support 108 (and second support 112) are preferably coupled to the body 104. This allows the first support 108 and the second support 112 to form a first channel 120 and a second channel 122, respectively. The first channel 120 and the second channel 122 allow for the support element 202 as shown in FIG. 2 to pass therethrough. Further, each of the first support 108 and the second support 112 may be of the same or a different general construct as the body 104 in terms of material, fill, etc.

In some embodiments (and as shown in FIG. 1A) there may be a pocket 126 in the body 104 or other portion of the modular building element 102. The pocket 126 may allow for the removal/insertion of any fill (or another material, item, etc.) in the body 104 or may allow for a recess for receiving a secondary item outside of the confines of the interior portion of the body 104. For example, the pocket 126 may allow for a hot and/or cold compress to be inserted therein. In another example, the pocket 126 repay allow for an aromatherapy material to be inserted therein. Depending on the intended usage, the material forming the body 104 may have insulating or conductive properties to better retain or transfer heat, cold, etc. Thicker and more robust/resilient support elements 202 and connecting structures 208 (as shown in FIG. 2) may be required depending on intended usage.

As shown in FIG. 2, there is a modular building element 102 with a support element 202, connecting structure 208, and threading device 204. Each of the support elements 202 and the connecting structure 208 is configured to interact with either of the first channel 120 and/or the second channel 122 of the first support 108 and second support 112, respectively. When joining multiple modular building elements 102 any combination of support elements 202 and connecting structures 208 may be used.

The support element 202 is a length of material configured to supply some amount of rigidity to the article formed by the user in accordance with embodiments of the present invention. A length of the support element 202 is such that it preferably allows for the support element 202 to pass through the channels of the first support 108/second support 112 of more than one modular building element 102 thereby allowing for more than one modular building element 102 to be joined (in addition to joining via the plurality of fastening elements 116). In at least one embodiment, the support element 202 is a cylindrical post formed from wood or other comparable material. As previously described herein, however, any number of desired materials may be used for the support element 202. These support elements 202 allow for the building of more rigid structures such as rigid cubes, play building structures, and the like.

The connecting structure 208 is a length of material configured to supply a more flexible quality (than the support element 202) while still providing properties that allow for the joining of multiple modular building elements 102 as opposed to solely via the plurality of fastening elements 116. In at least one embodiment, the connecting structure 208 is a ribbon or ribbon-like material that is flexible but sufficiently resilient and resistant to tearing such that the modular building element 102 retains the desired flexible qualities when joined.

A threading device 204 is preferably included to be used with the connecting structure 208 due to the flexible nature of the connecting structure 208 and the dimensions, material, etc. associated with the respective channel through which the connecting structure 208 is intended to pass through. The threading device 204 is therefore formed from a sufficiently rigid material (such as a plastic or polymer as previously described herein) to allow for the threading device 204 to be passed through either the first channel or the second channel. At one end, the threading device 204 has an aperture 206 configured to allow the connecting structure 208 to pass through and be selectively retained by the threading device 204 as it is passed through the respective channel. An opposing end of the threading device 204 is preferably blunt (rounded) so as to not cause damage to the respective channel as the threading device 204 is passed through.

It is preferable that a modular building kit consistent with the present application provides at least a plurality of modular building elements (as previously described herein), at least two support structures, at least one connecting structure, and at least one threading device. More or less of any of the components and the configurations (type of material, fastener configuration, shape, printed insignia, etc.) may be varied as desired.

Figure 3:
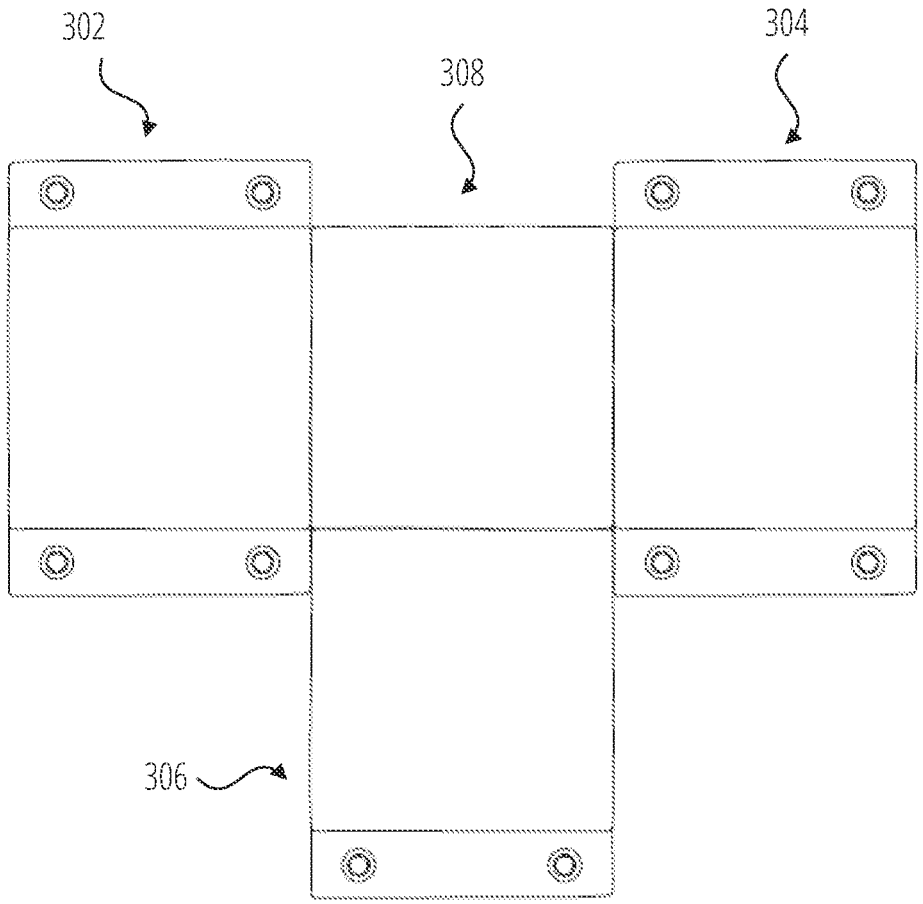
FIG. 3 illustrates the joining of multiple modular building elements in accordance with one embodiment.

As shown in FIG. 3, there are multiple (first modular building element 302, second modular building element 304, third modular building element 306, and fourth modular building element 308) modular building elements coupled together via the plurality of fastening elements 116 associated with said devices. Generally, the modular building elements are sized and shaped such that the modular building elements can be combined in a "patchwork" format. That is, the plurality of fastening elements 116 disposed on the front side 106 of one modular building element is positioned to join with the plurality of fastening elements 116 on a back side 124 of another modular building element. As previously noted herein, the plurality of fastening elements 116 located on the front side 106 are positioned on the first support 108 and the second support 112, whereas the plurality of fastening elements 116 located on the back side 124 are located on the vertices 118.

Thus, the plurality of fastening elements 116 on the fourth modular building element 308, as shown, is coupled to each of the first modular building element 302 and the second modular building element 304, and the third modular building element 306. It is coupled to the first modular building element 302 and the second modular building element 304 via the plurality of fastening elements 116 on the first support (not shown) and second support (not shown) of the fourth modular building element 308. Said plurality of fastening elements 116 are coupled to the plurality of fastening elements 116 on the respective body portion of the first modular building element 302 and the second modular building element 304.

The third modular building element 306 is then coupled to the fourth modular building element 308 via the plurality of fastening elements 116 on the support (not shown) of the third modular building element 306. Said fourth modular building element 308 is configured to receive, via the plurality of fastening elements 116 on the body portion of the fourth modular building element 308, said plurality of fastening elements 116 on the third modular building element 306. As can be seen in FIG. 3, the fourth modular building element 308 has a "free" or open side to which yet another modular building element may be coupled if desired. The same applies for each of the first modular building element 302, second modular building element 304, and third modular building element 306 via the plurality of fastening elements 116 visible as well as the plurality of fastening elements 116 on the rear of the body portion not shown. One may continually build out using the modular building elements to create any of the articles shown in FIGS. 4-6, as well as virtually any other article desired.

Figure 4:
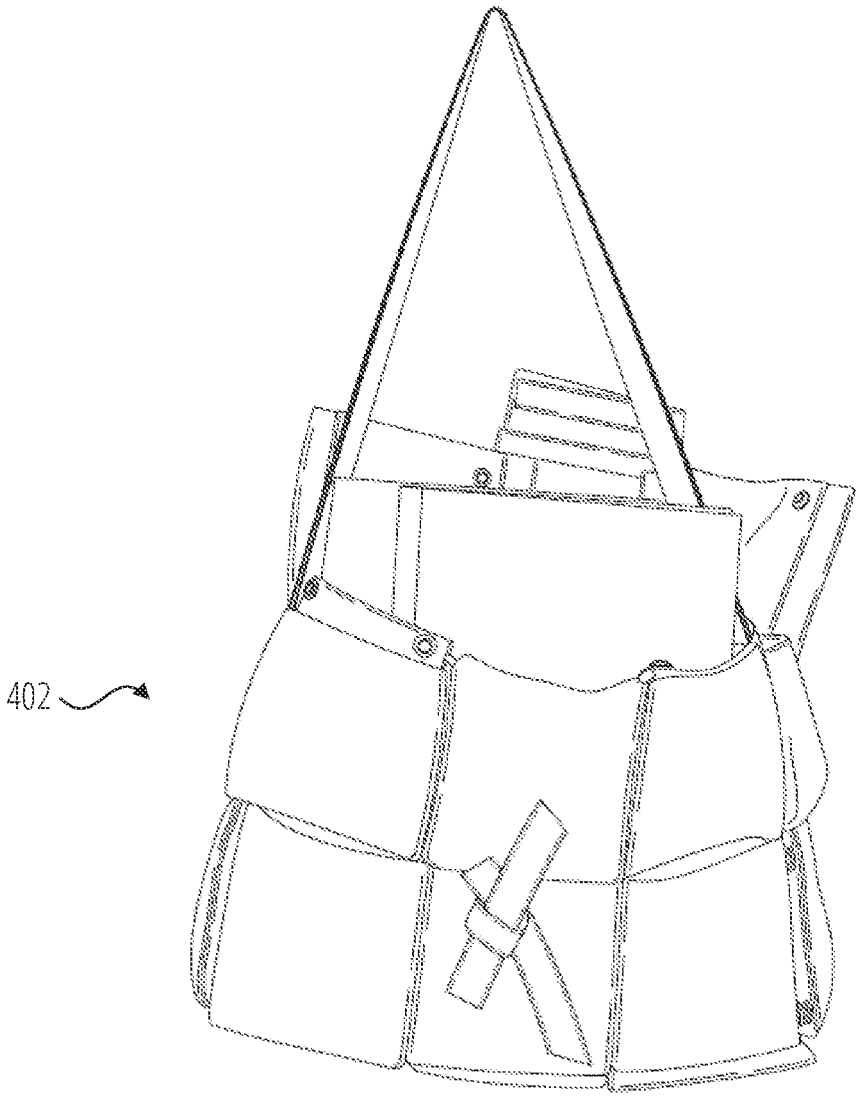
FIG. 4 illustrates a first assembly of the modular building kit in accordance with one embodiment.
Figure 5:
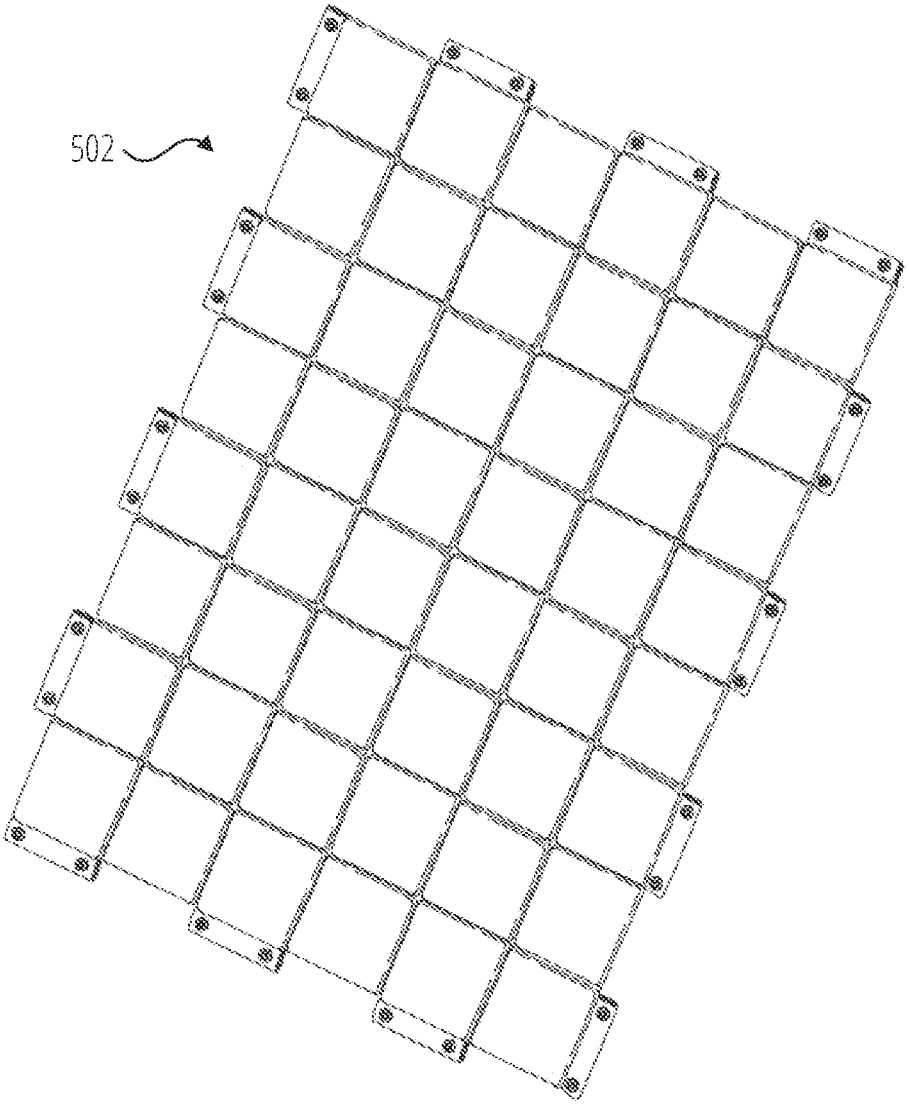
FIG. 5 illustrates a second assembly of the modular building kit in accordance with one embodiment.
Figure 6:
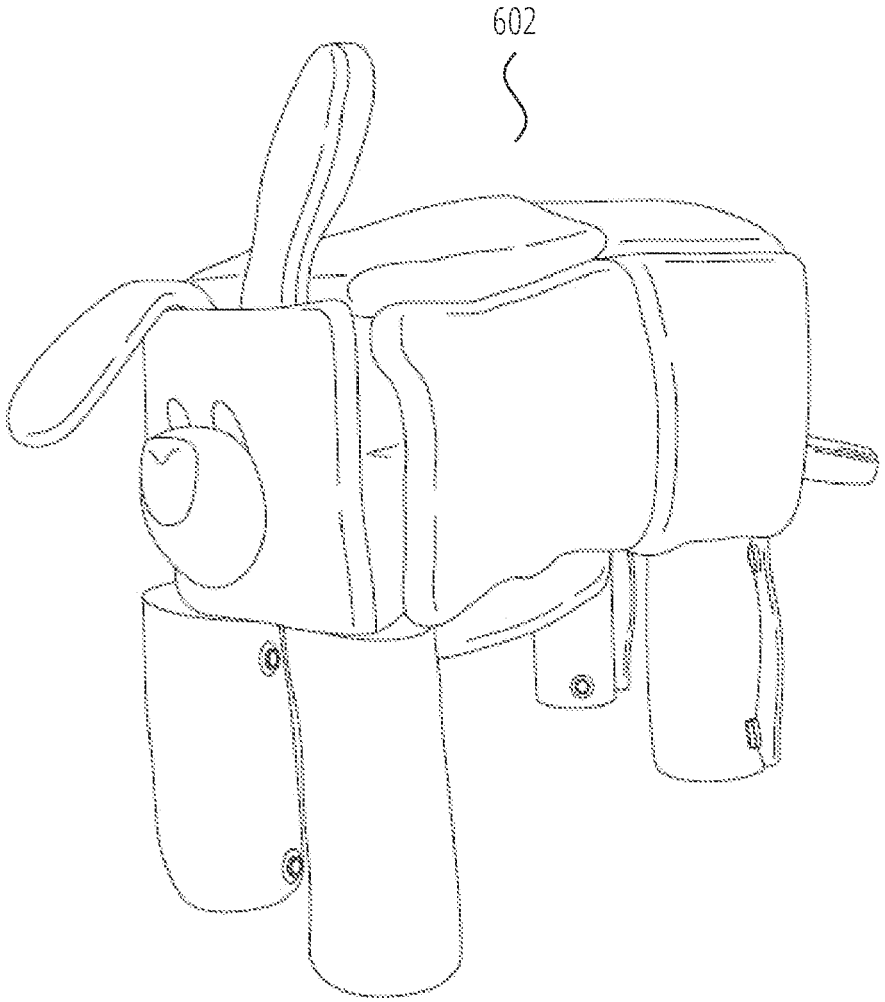
FIG. 6 illustrates a third assembly of e modular building kit in accordance with one embodiment.

Referring now to FIGS. 4-6, shown are various articles built with a modular building kit and/or other embodiments as described herein. Shown is a pocketbook 402, blanket 502, and toy animal 602. Each of the pocketbook 402, blanket 502, and toy animal 602 are comprised of various permutations of modular building elements 102, support elements 202, a threading device 204, and a connecting structure 208. While these particular embodiments have been shown in the drawings, virtually any combination of elements with a modular building kit or modular building kits may be combined with (or without) additional constructing elements to create an article of desire and such articles are contained under the purview of this application.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A modular building element consisting of:

a body having a front side, a back side, a first edge, and a second edge, wherein the body is formed from a first textile-based material;

a first support having a front side and a back side, the first support being coupled to the first edge of the body, wherein the first support consists of a first channel passing therethrough, wherein the first channel spans a length of the first support, and wherein the first support is formed from a second textile-based material;

a second support having a front side and a back side, the second support being coupled to the second edge of the body, wherein the second edge of the body is on an opposing side of the body from the first edge of the body;

wherein the second support consists of a second channel passing therethrough, wherein the second channel spans a length of the second support, and wherein the second support is formed from a third textile-based material; and eight fastening elements with four of the eight fastening elements being coupled to the front side of the body and two of the eight fastening elements being coupled to the back side of the first support and two of the eight fastening elements being coupled to the back side of the second support;

wherein the two of the fastening elements coupled to the first support are separated by a first distance;

wherein the two of the fastening elements coupled to the second support are separated by a second distance;

wherein two of the four fastening elements coupled to the front side of the body are separated by the first distance;

wherein two of the four fastening elements coupled to the front side of the body are separated by the second distance; and wherein the front side of the body and the back side of the first support and the second support are on opposing sides of the modular building element.

2. The modular building element of claim 1 wherein the first textile-based material, the second textile-based material, and the third textile-based material are the same or different.

3. A modular building kit comprising:

a plurality of modular building elements with each of the plurality of modular building elements consisting of:

a body having a front side and a back side, a first support having a front side and a back side, the first support being coupled to a first side of the body, wherein the first support consists of a first channel passing therethrough, and wherein the first channel spans a length of the first support;

a second support having a front side and a back side, the second support being coupled to a second side of the body, wherein the second side of the body is on an opposing side of the body from the first side of the body;

wherein the second support consists of a second channel passing therethrough, wherein the second channel spans a length of the second support;

eight fastening elements with four of the eight fastening elements being coupled to the front side of the body and two of the eight fastening elements being coupled to the back side of the first support and two of the eight fastening elements being coupled to the back side of the second support;

wherein the two of the fastening elements coupled to the first support are separated by a first distance;

wherein the two of the fastening elements coupled to the second support are separated by a second distance;

wherein two of the four fastening elements coupled to the front side of the body are separated by the first distance;

wherein two of the four fastening elements coupled to the front side of the body are separated by the second distance; and wherein the front side of the body and the back side of the first support and the second support are on opposing sides of the modular building element; and at least two support structures.

4. The modular building kit of claim 3 further comprising a threading device and a connecting structure.

5. The modular building kit of claim 4 wherein the threading device has a first end and a second end with an aperture disposed at the first end, the aperture configured to receive the connecting structure therethrough.

6. The modular building kit of claim 4 wherein the connecting structure is a length of ribbon.

7. The modular building kit of claim 4 wherein the body of the plurality of modular building elements has differing shapes.

* * * * *